US011532292B2

(12) United States Patent
Lenz

(10) Patent No.: US 11,532,292 B2
(45) Date of Patent: Dec. 20, 2022

(54) SPRUNG STRIKER ASSEMBLY FOR USE WITH AN IDIOPHONE

(71) Applicant: Michael Lenz, Pueblo West, CO (US)

(72) Inventor: Michael Lenz, Pueblo West, CO (US)

( * ) Notice: Subject to any disclaimer, the term of this patent is extended or adjusted under 35 U.S.C. 154(b) by 173 days.

(21) Appl. No.: 17/146,137

(22) Filed: Jan. 11, 2021

(65) Prior Publication Data

US 2021/0217389 A1 Jul. 15, 2021

Related U.S. Application Data

(60) Provisional application No. 62/958,895, filed on Jan. 9, 2020.

(51) Int. Cl.
*G10D 13/10* (2020.01)
*G10D 13/06* (2020.01)

(52) U.S. Cl.
CPC ..... *G10D 13/10* (2020.02); *G10D 13/06* (2013.01)

(58) Field of Classification Search
CPC ..... G10D 13/10; G10D 13/06; G10D 13/00
See application file for complete search history.

(56) References Cited

U.S. PATENT DOCUMENTS 6,759,583 B2 * 7/2004 Mizuno ..... G10D 13/12 84/422.4

* cited by examiner

*Primary Examiner* — Kimberly R Lockett
(74) *Attorney, Agent, or Firm* — Leyendecker & Lemire

(57) ABSTRACT

A sprung striker assembly for striking an idiophone is described. The sprung striker assembly for striking an idiophone typically comprises a body member, a striker head, a striker tip, and a spring mechanism. In one variation, the striker head is configured for use with a struck idiophone, such a mounted idiophone block or cow bell. In other variations, the striker head further includes an idiophone, such as a rattle, jingles, cymbals, castanets, or any other suitable noisemaker, incorporated into the striker head.

19 Claims, 13 Drawing Sheets

FIG. 3A
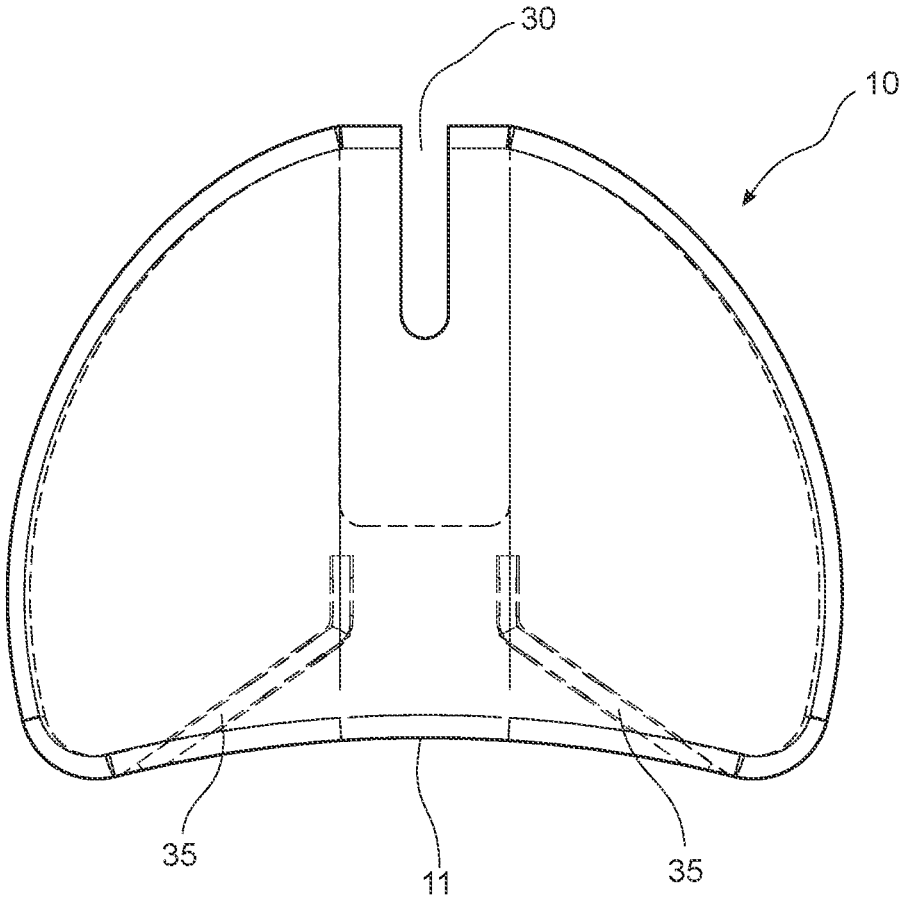
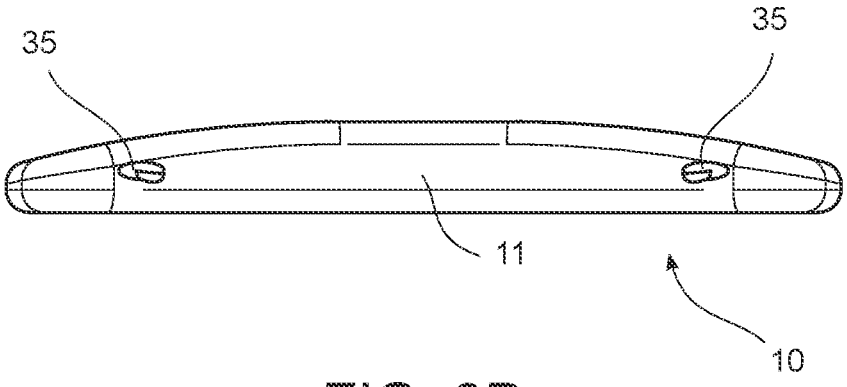
FIG. 3B

FIG. 4B
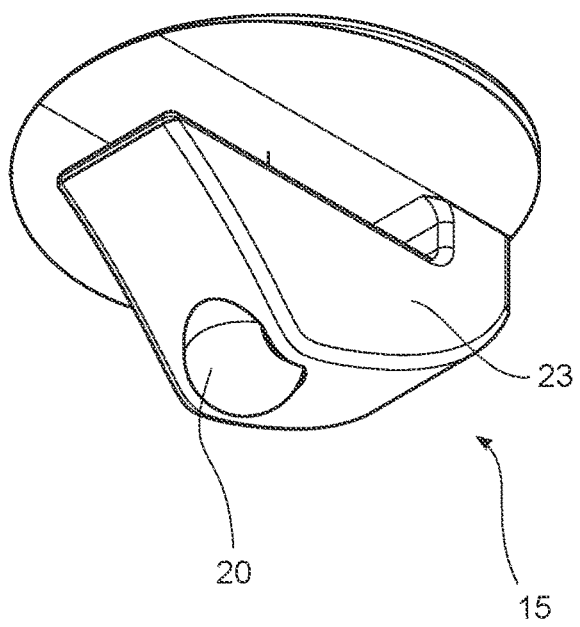
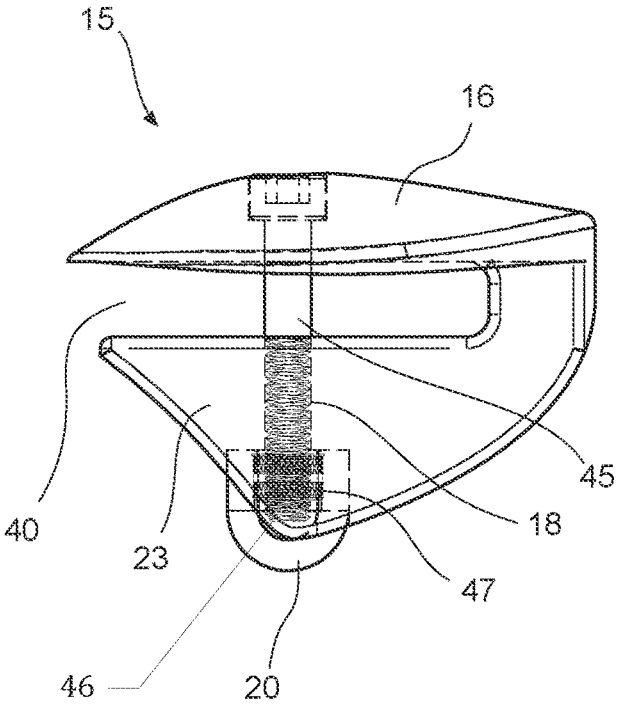
FIG. 4A
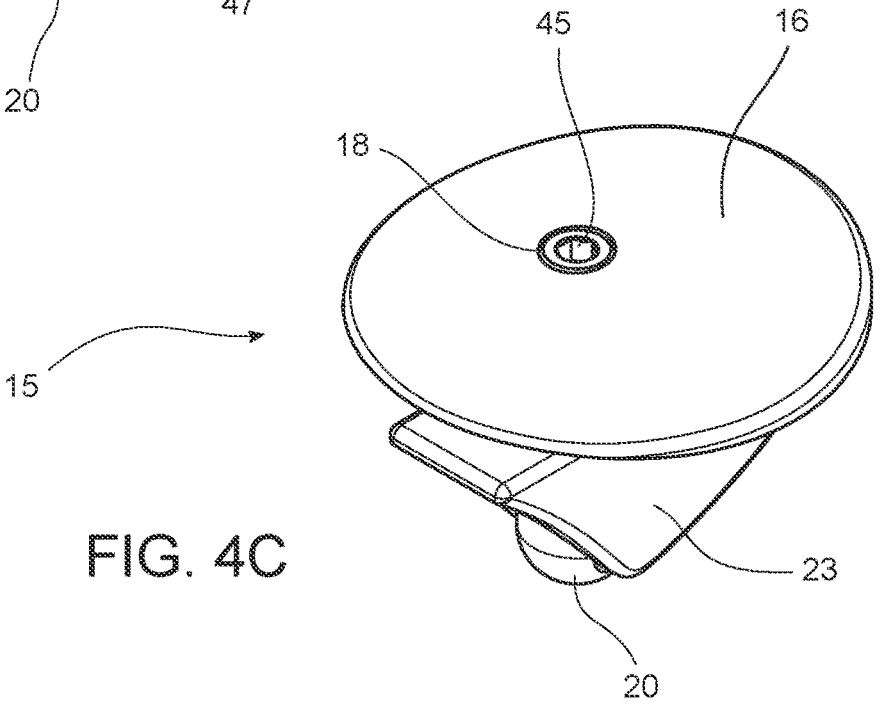
FIG. 4C

SPRUNG STRIKER ASSEMBLY FOR USE WITH AN IDIOPHONE

CROSS-REFERENCE TO RELATED APPLICATION

The present application claims the benefit and priority to U.S. Provisional Patent Application No. 62/958,895 filed Jan. 9, 2019, entitled Hand Striker Assembly for a Drum Mounted Idiophone, having the same inventor as the present application, the entire contents of which are hereby incorporated by reference. The contents of U.S. Pat. No. 10,037,747 filed May 31, 2017, entitled Peripheral Drum Quick Mount Idiophone and Associated Flexible Drum Sticks, having the same inventor as the present application, are also hereby incorporated by reference.

BACKGROUND

There are many types of drums known in the art. Some drums, such as a snare drum or floor tom, are played with a drum stick. Other drums, such as bongos or congas, are played with the hands. While there are many types of drums, individually, drums are generally limited in the types of sounds they can produce. Therefore, percussionists may often use idiophones—such as blocks, bells, shakers, tambourines, castanets, guiros, and others—to create certain characteristic sounds apart from the sound created by the drum or drums, as may be desirable during their performance of a musical composition.

In some instances, the idiophone may be mounted to the rim of a drum. This enables a percussionist to strike the mounted idiophone with their drum stick to create the desired characteristic sound, and subsequently resume drumming while maintaining the desired tempo or musical pace of the musical composition by eliminating the need to pick up and place down the idiophone or their drum stick or sticks. While the mounted idiophone enables a percussionist to strike the idiophone with a drum stick, an issue arises when a percussionist is utilizing a hand drum, as the mounted idiophone will not produce the same characteristic sound when it is struck with a percussionist's hand. Thus, when using a hand drum in combination with a mounted idiophone, a percussionist would need to pick up and set down a drum stick to create the desired characteristic sound when striking the mounted idiophone. This often makes maintaining the desired tempo or musical pace of the musical composition far more difficult for a percussionist.

BRIEF DESCRIPTION OF THE DRAWINGS

FIG. 3A is a top view of a body member of a first embodiment sprung striker assembly.

FIG. 3B is a side view of a body member of a first embodiment sprung striker assembly.

FIG. 4A is an interrupted view of striker head of a sprung striker assembly.

FIG. 4B is a bottom perspective view of a striker head of a sprung striker assembly.

FIG. 4C is a perspective view of a striker head of a sprung striker assembly.

DETAILED DESCRIPTION

Figure 1:
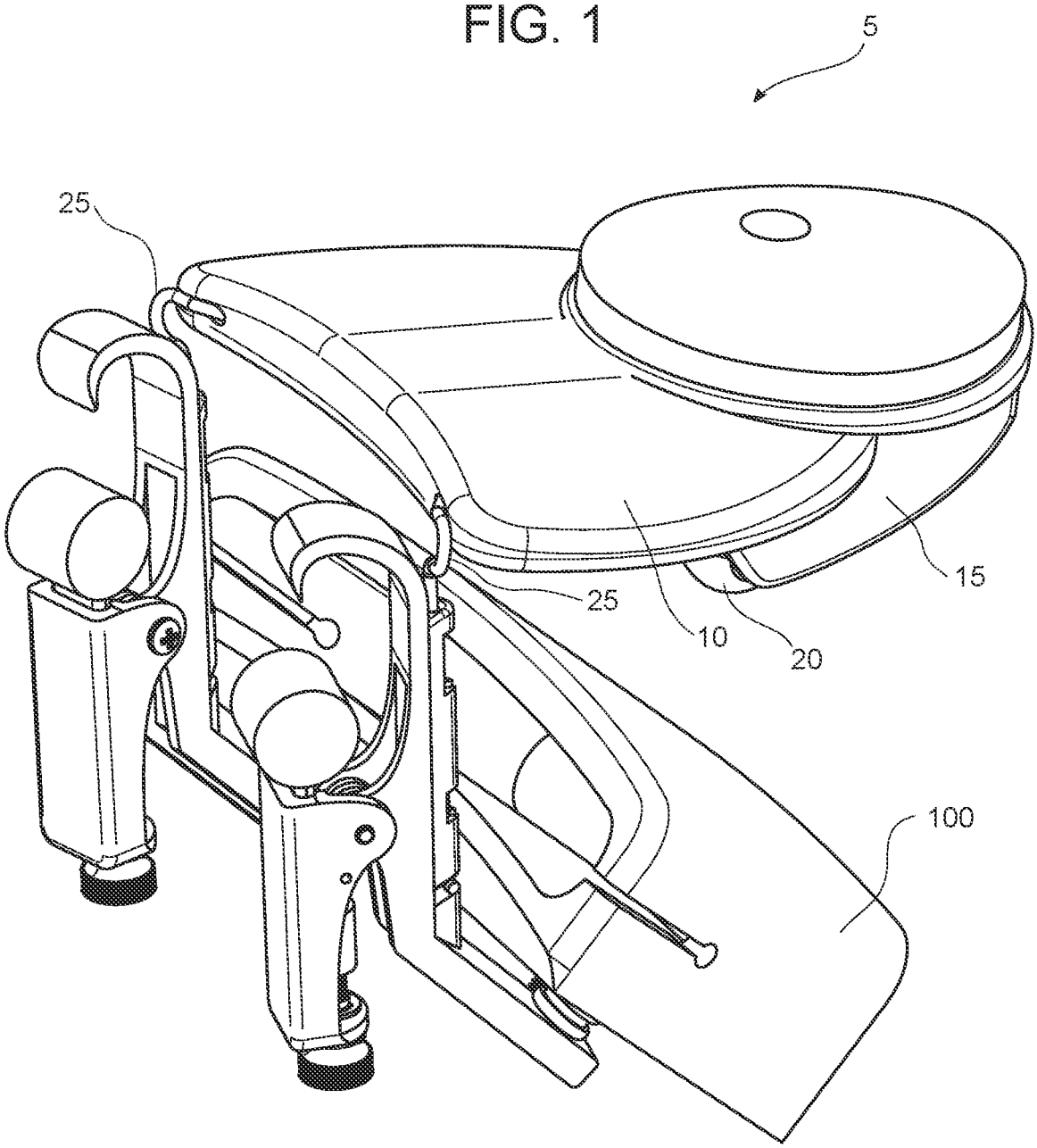
FIG. 1 is a perspective view of a first embodiment sprung striker assembly.

Generally, most embodiments of the present invention include a sprung striker assembly for striking a mounted idiophone, the sprung striker assembly including a body member, an adjustable striker head, a striker tip, and a spring mechanism. The striker tip is configured for threadably receiving a threaded bolt therein, and in some variations, may further include a threaded tip insert. In one variation, the striker head is configured for use with a struck idiophone, such a mounted idiophone block or cow bell. In other variations, the striker head further includes an idiophone, such as a rattle, jingles, cymbals, castanets, or any other suitable noisemaker, incorporated into the striker head.

In one embodiment, the sprung striker assembly is operationally coupled to a drum mounted idiophone with a spring mechanism, the drum mounted idiophone being secured to a hand drum with one or more drum rim clips. In the second embodiment, the sprung striker assembly is operationally coupled to a rod having a rod mounted idiophone, the sprung striker assembly being operationally coupled to the rod with a rod adaptor assembly, wherein the rod adaptor assembly typically comprising a body member, a leaf spring, and a rod mount assembly.

The sprung striker assembly enables a percussionist using a hand drum to strike a mounted idiophone with the percussionist's hand, allowing a percussionist to create the desired characteristic sound either in unison with the hand drum or independently from the hand drum, while maintaining the desired tempo or musical pace of the musical composition by eliminating the need to pick up and place down a drum stick or sticks to strike the idiophone. The sprung striker assembly is also advantageous to percussionists using a drum stick to strike a mounted idiophone, as the interchangeable striker tip ensures that the idiophone is struck in the same location each time the sprung striker assembly is struck, ensuring the user can create the desired idiophone sound consistently.

Terminology

The terms and phrases as indicated in quotation marks (" ") in this section are intended to have the meaning ascribed to them in this Terminology section applied to such term throughout this document—including in the claims—unless clearly indicated otherwise in context. Further, as applicable, the stated definitions are to apply, regardless of the word or phrase's case, to the singular and plural variations of the defined word or phrase.

The term "about," as used in this specification and appended claims, refers to plus or minus 20% of the value given.

The term "approximately," as used in this specification and appended claims, refers to plus or minus 10% of the value given.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "idiophone," as used in this specification and appended claims, refers to an instrument that vibrates when struck to produce a sound, such as, but not limited to a block, a bell, a rattle, or a gong.

The terms "generally" and "substantially," as used in this specification and appended claims, mean mostly, or for the most part.

The term "music wire," as used in this specification and appended claims, means the type of wire made for use in piano strings.

The term "or," as used in this specification and the appended claims, is not meant to be exclusive—rather the term is inclusive, meaning either or both.

References in the specification to "one embodiment," "an embodiment," "another embodiment," "a preferred embodiment," "an alternative embodiment," "one variation," "a variation," and similar phrases mean that a particular feature, structure, or characteristic described in connection with the embodiment or variation, is included in at least an embodiment or variation of the invention. The phrase "in one embodiment," "in one variation," or similar phrases, as used in various places in the specification, are not necessarily meant to refer to the same embodiment or the same variation.

Directional and relationary terms such as, but not limited to, left, right, nadir, apex, top, bottom, vertical, horizontal, back, front, longitudinal, and lateral are relative to each other and are dependent on the specific orientation of a applicable element or article, and are used accordingly to aid in the description of the various embodiments and are not necessarily intended to be construed as limiting.

A First Embodiment Sprung Striker Assembly for Striking an Idiophone

Figure 2:
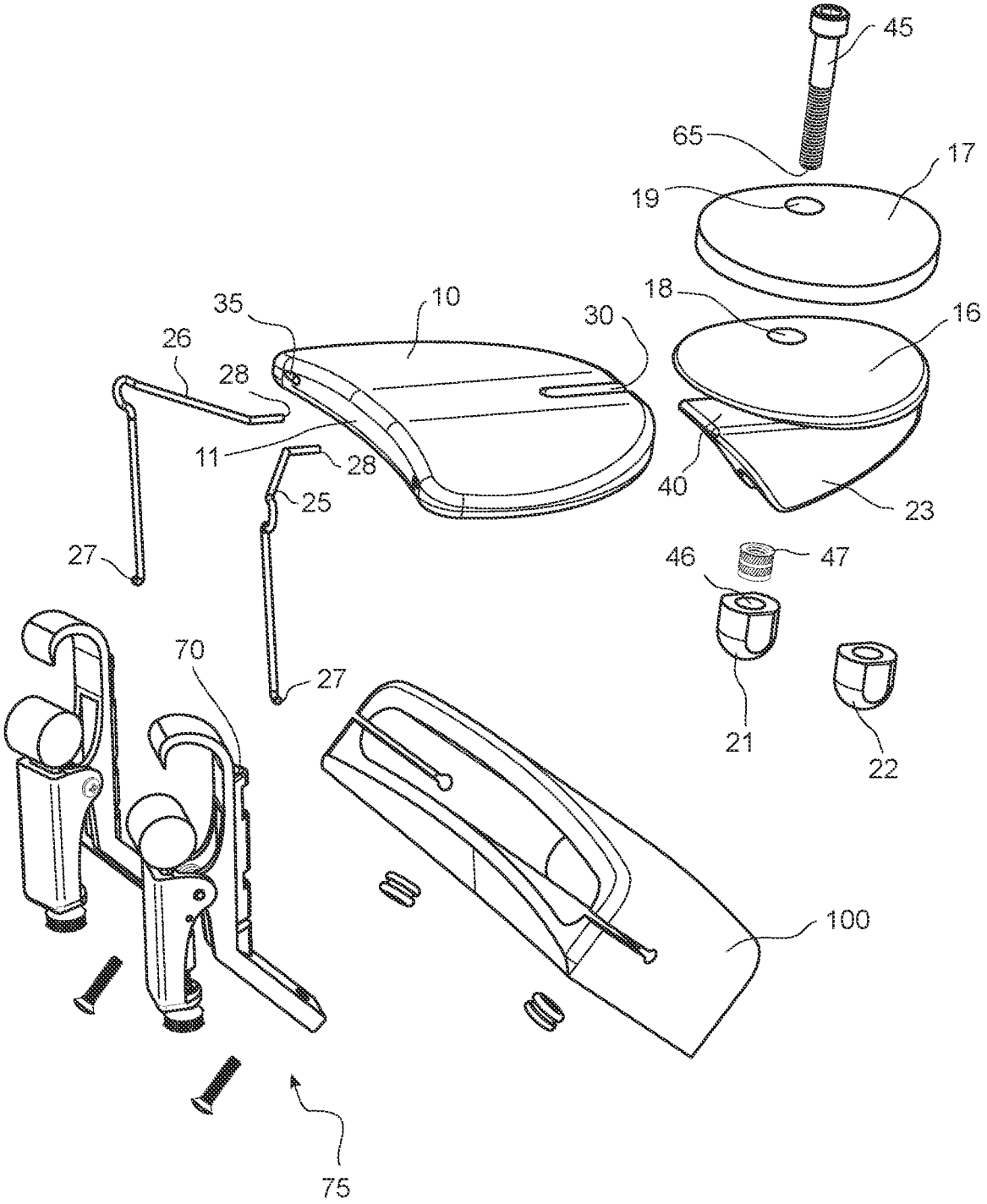
FIG. 2 is an exploded view of a first embodiment sprung striker assembly.

A first embodiment sprung striker assembly 5 for striking an idiophone 100 is illustrated in FIGS. 1 & 2. Typically, the first embodiment sprung striker assembly 5 for a striking an idiophone 100 comprises a body member 10, a striker head 15, a striker tip 20, and a spring mechanism 25 including a striker attachment mechanism.

Referring to FIG. 3A, a body member 10 having a linear bolt slot 30 is shown. As shown in FIG. 3A, the side of body member 10 proximate the drum, drum-facing side 11, may be concave in shape, or rounded inward, to allow for sprung striker assembly 5 to be close in proximity to the edge of the drum. This configuration can reduce the distance a user must reach to strike the sprung striker assembly 5 while drumming, which is desirable to facilitate the ease in which the percussionist can maintain the desired tempo or rhythm. Drum-facing side 11 of body member 10 further includes at least one bored hole 35 for receiving and securing a spring mechanism 25 therein. Typically, body member 10 comprises a plastic material. In other variations, body member 10 can comprise wood, metal, or any other suitable material.

Referring to FIGS. 2, 4A-4C, a striker head 15 having a mounting channel 40, a top striking portion 16, and a bottom striker tip portion 23 is shown. The top striking portion 16 of striker head 15 is typically a substantially smooth surface, to allow for the user to comfortably strike either the top surface of body member 10 or striker head 15. The top striking portion 16 of striker head 15 further includes a bored hole 18, wherein the bored hole 18 is substantially perpendicular to mounting channel 40. In some variations, a sound dampening cap 17 including a cap hole 19 may be included on the top striking surface 16 of striker head 15. Typically, sound dampening cap 17 comprises a sound dampening or sound deadening material, such as high density foam, to allow for a user to strike the top striking surface 16 of striker head 15 with a drum stick with minimal sound, ensuring the resulting sound is predominately that which is created by the striker tip 20 striking the idiophone 100. Additionally, the sprung striker assembly 5 can also protect the idiophone 100 from damage that may otherwise occur when a user strikes the idiophone 100 with the user's drum stick.

The striker head 15 allows for the user to adjust the position of the striker head 15 with respect to body member 10, as may be necessary to ensure its bottom striker tip portion 23 strikes idiophone 100 at the location selected by the user each time the sprung striker assembly 5 is struck, producing the desired characteristic sound consistently. The striker head 15 also allows for the sprung striker assembly 5 to be compatible with various drum rim configurations, as the position of a drum mounted idiophone may vary depending on the selected drum, thereby necessitating the user adjust the position at which the striker head 15 is coupled with body member 10.

As illustrated in FIGS. 1-2, the striker head 15 is adjustably coupled to body member 10. Typically, striker head 15 is coupled to body member 10 by sliding mounting channel 40 over linear bolt slot 30. Once the striker head 15 is positioned at the desired location along linear bolt slot 30, the striker head 15 is secured into place by receiving threaded bolt 45 through each of bored hole 18, mounting channel 40, linear bolt slot 30, and when applicable, cap hole 19. A striker tip 20 is then threadably received on the distal end 65 of threaded bolt 45, and threaded bolt 45 is tightened until striker tip 20 is secured with striker head 15, and striker head 15 is secured into place.

The location at which bottom striker tip portion 23 or striker tip 20 strikes idiophone 100 can be adjusted simply by adjusting the position at which the striker head 15 is coupled with body member 10. This can be accomplished by loosening threaded bolt 45 or striker tip 20, and sliding mounting channel 40 of striker head 15 along linear bolt slot 30 until striker tip 20 is positioned to strike idiophone 100 at the desired location, and then re-securing striker head 15 in place by threadably receiving striker tip 20 on the distal end 65 of threaded bolt 45, and re-tightening threaded bolt 45 until the striker tip 20 is secured with the striker head 15 and the striker head 15 is again secured into place.

Figure 7A:
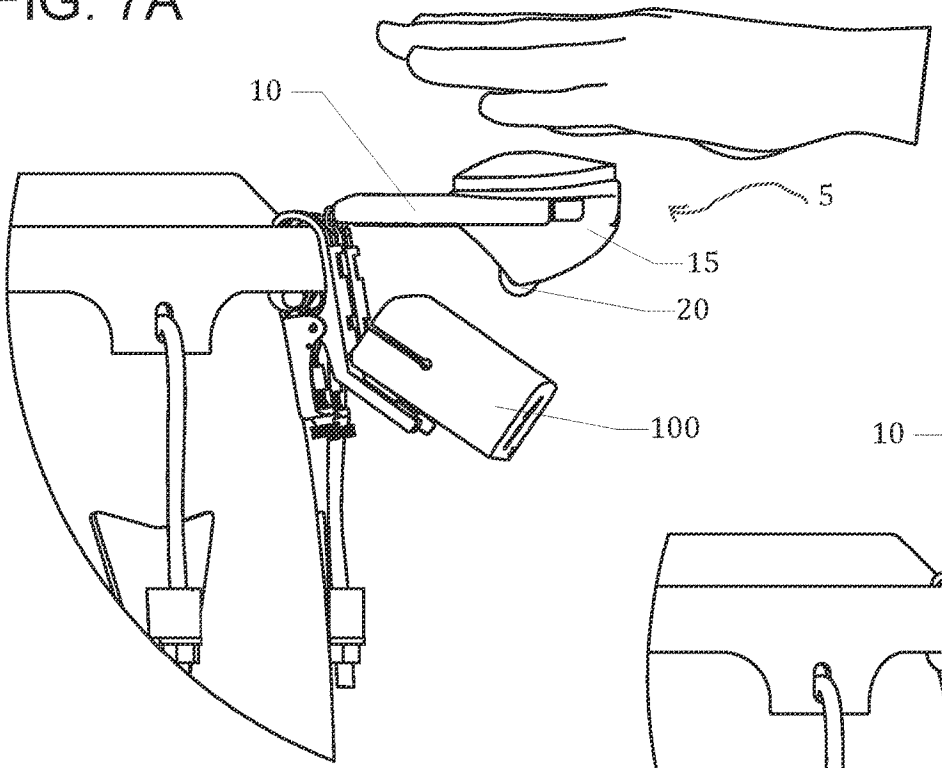
FIG. 7A is a perspective view of a first embodiment sprung striker assembly.
Figure 7B:
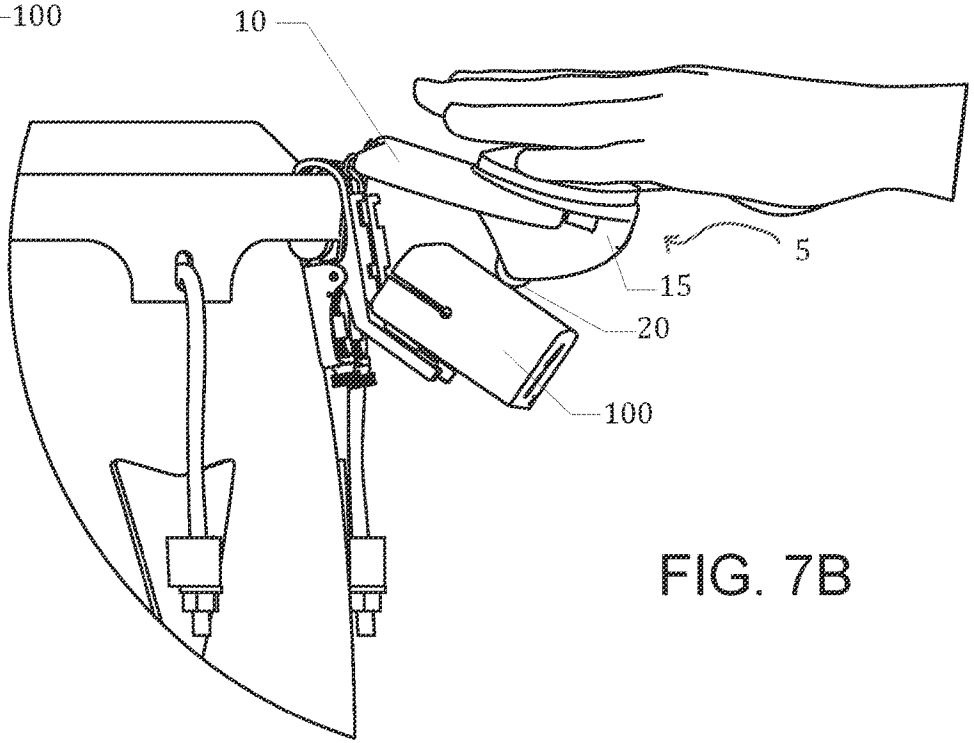
FIG. 7B is a perspective view of a first embodiment sprung striker assembly.

Referring to FIGS. 7A & 7B, a striker tip 20 is shown. When the user strikes sprung striker assembly 5, the distal end of striker tip 20 comes into contact—or 'strikes'—idiophone 100, thereby creating the desired characteristic sound from idiophone 100. Unlike when a user strikes an idiophone directly, the striker tip 20 enables the user to cause idiophone 100 to be stuck at the same location each time the sprung striker assembly 5 is struck. This ensures idiophone 100 creates the desired characteristic sound in a consistent manner.

In some variations, as shown in FIG. 2, striker top 20 may comprises a first striker tip 21 and a second striker tip 22. To enable a user to change the tone or volume of the resulting sound from idiophone 100 when it is struck by sprung striker assembly 5, a first striker tip 21 comprising a first material is removed from threaded bolt 45, and a second striker tip 22 having a second material is threadably received on threaded bolt 45, and threaded bolt 45 is tightened with the second striker tip 22. Striker tip 20 may be comprised of a plurality of suitable materials, depending on the characteristic sound one desires to produce when idiophone 100 is struck with striker tip 20. For example, in one variation, a first striker tip 21 may comprise a soft plastic material, and a second striker tip 22 may comprise a metal material, such as steel. Other suitable materials can include plastics of varying degrees of hardness, wood, polymers, leather, fabric and other suitable materials.

As shown in FIG. 2, the striker tip 20 typically includes a threaded bore 46 configured for threadably receiving threaded bolt 45 therein. Striker tip 20 is configured to be threadably received on a distal end 65 of threaded bolt 45 and securely coupled with striker head 15 when tightened with threaded bolt 45. In some variations, threaded bore 46 may further include a threaded tip insert 47 received therein. The threaded tip insert 47 typically comprises a metal material, and can decrease the wear on striker tip 20 that may otherwise result from the repeated removal and re-coupling of threaded bolt 45 with striker tip 20. In some variations, the weight of threaded tip insert 47 may be increased or decreased to change the tone or volume of the idiophone 100 when struck by the striker tip 20. In variations wherein a bolder or more pronounced characteristic sound is desired, the weight of threaded tip insert 47 or threaded bolt 45 may be increased. As shown in FIG. 4A, threaded bore 46 is typically configured such that vertical axis of striker tip 20 and threaded bolt 45 is substantially perpendicular when the sprung striker assembly 5 is in a striking position.

Figure 5B:
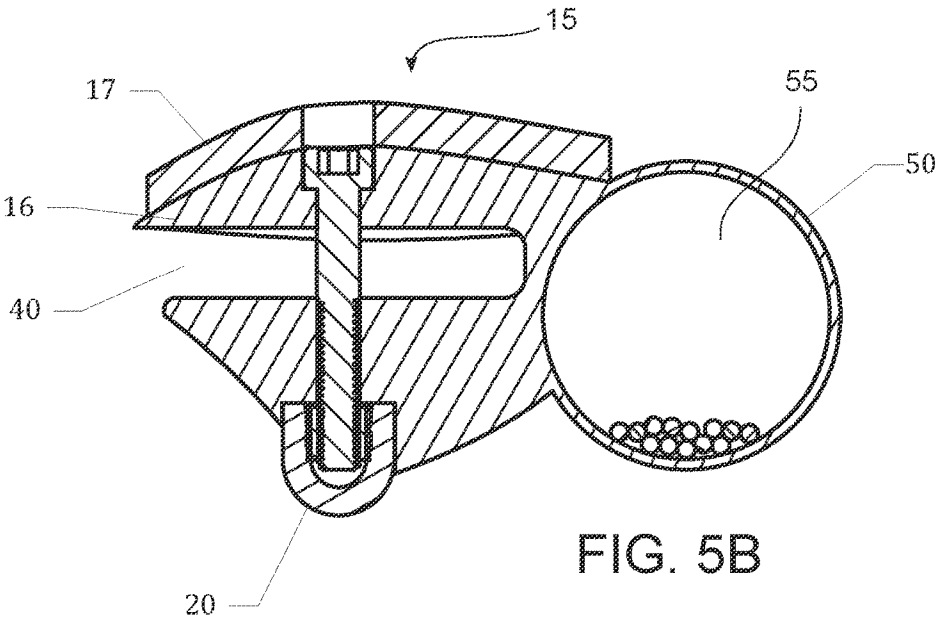
FIG. 5B is a cross-sectional view of striker head of a sprung striker assembly.
Figure 5C:
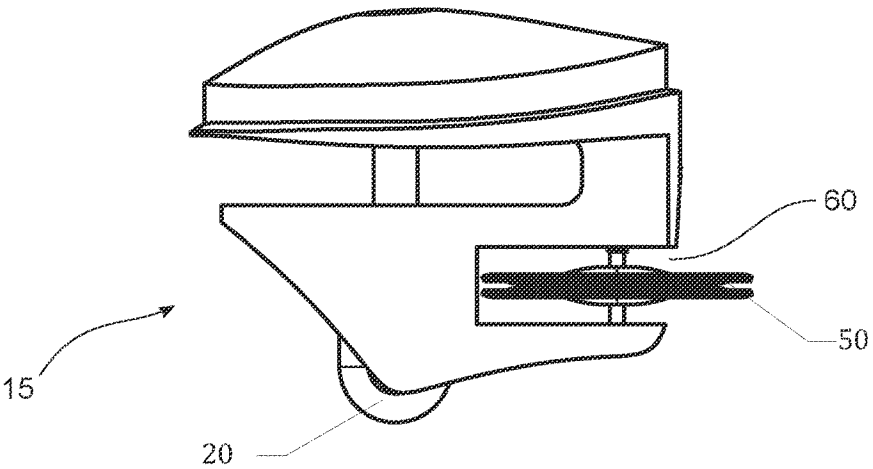
FIG. 5C is a side view of a striker head of a sprung striker assembly.
Figure 5A:
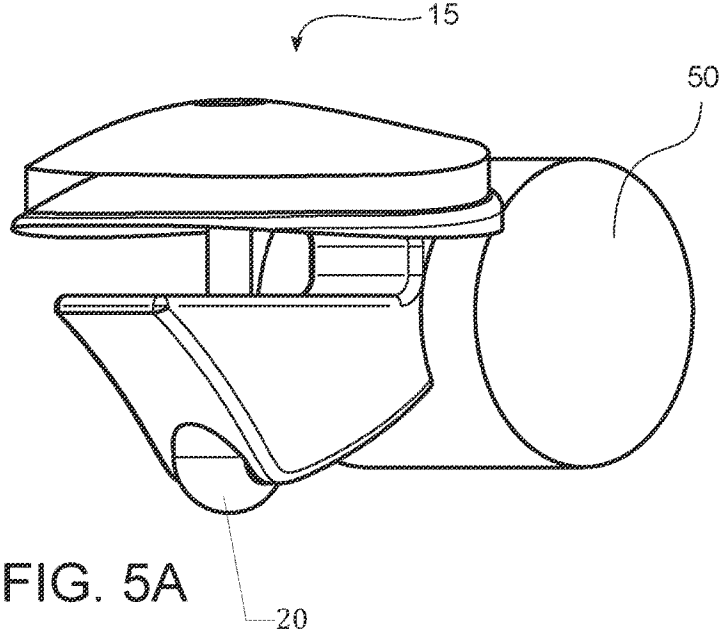
FIG. 5A is a side perspective view of a striker head of a sprung striker assembly.

Referring to FIGS. 5A-5C, in some variations the striker head 15 may further include a striker head idiophone 50, such as a rattle, jingles, cymbals, castanets, or any other suitable struck idiophone. In these variations, striker head idiophone 50 is disposed at or near the distal end of striker head 15, as shown in FIG. 5A. As shown in FIG. 5B, in variations wherein the striker head idiophone 50 comprises a shaker or rattle-type noisemaker, the striker head idiophone 50 comprises one or more internal hollow chambers 55 wherein a plurality of metal balls or similar percussion shaker media are contained therein. As shown in Figure C, in variations wherein the striker head idiophone 50 comprises jingles, cymbals, or similar noisemakers, the striker head 15 further includes one or more jingle slots 60 wherein a plurality of jingles, cymbals, or similar noisemakers are contained therein.

In variations wherein the striker head 15 includes a striker head idiophone 50, the striker tip 20 typically comprises a sound-dampening material, such as rubber. In these variations, striker tip 20 provides for the controlled rapid stop of striker head 15 while dampening the sound of striker head 15 coming into contact with idiophone 100, as well as any non-idiophone, such as a mounted block having a striking surface, ensuring that the resulting dominant sound is that which emits from striker head idiophone 50.

As shown in FIGS. 1 & 2, sprung striker assembly 5 is operationally coupled to a drum mounted idiophone with at least a first spring mechanism 25 having a proximal spring end 27 and a distal spring end 28. As illustrated in FIG. 2, the first spring mechanism 25 comprises a substantially L-shaped elastically resilient wire, such as a piano wire or music wire. In other variations, the first spring mechanism 25 may comprise a plastic rod, or other suitable material or configuration known in the art. In some variations, including the variation illustrated in FIG. 2, a second spring mechanism 26 may be further included. Typically, in variations wherein the sprung striker assembly 5 comprises a first spring mechanism 25 and a second spring mechanism 26, the first and second spring mechanisms 25 and 26 comprise the same material.

Referring to FIG. 1, a body member 10 coupled with an idiophone 100 is shown. To couple body member 10 to an idiophone 100, an attachment mechanism comprising distal spring end 28 is inserted into a bored hole 35 of body member 10, as shown in FIG. 2. The proximal spring end 27 is then inserted into a bored stem 70 of a drum rim clip 75. In other variations, the proximal spring end 27 may be directly coupled to the drum rim clip 75.

Depending on the type of drum as well as its manufacturer, the distance between the drum rim hoop and the drum head playing surface often varies. To enable compatibility with most drum types and manufacturers, the length of proximal spring end 27 may vary depending on the length necessitated by the drum selected by the user. Additionally, a first spring mechanism 25 having a proximal spring end 27 of one length may be interchangeable with a second spring mechanism 25 having a proximal spring end 27 of a differing length. To exchange a first spring mechanism 25 with a second spring mechanism 26, the user simply removes the respective proximal spring end 27 and distal spring end 28 of the first spring mechanism 25 from bored hole 35 and bored stem 70, and then inserts the respective proximal spring end 27 and distal spring end 28 of the second spring mechanism 26 into bored hole 35 and bored stem 70.

Figure 6A:
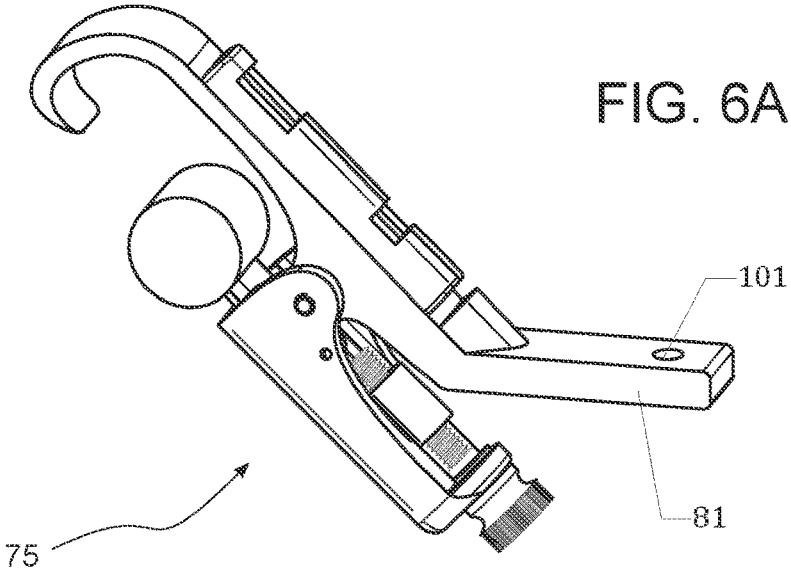
FIG. 6A is a perspective view of a drum clip.
Figure 6B:
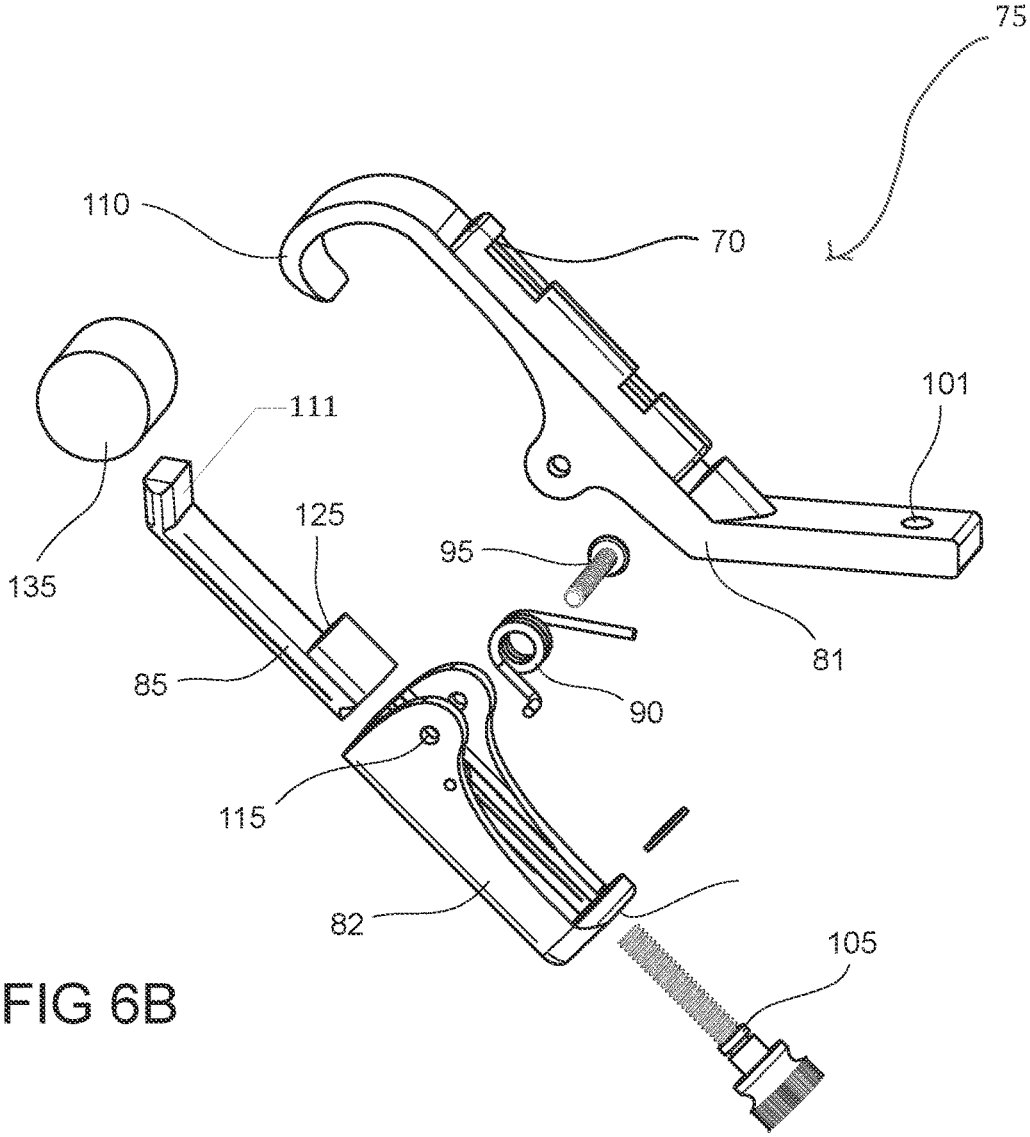
FIG. 6B is an exploded view of a drum clip.

The idiophone block is typically mounted to the drum rim by one or more drum rim clips 75. As shown in FIGS. 6A-6B, the drum rim clip 75 typically comprises a first lever arm 81, a second lever arm 82 having an adjustable slider 85, a spring member 90, a pivot rod 95, and a clip adjustment screw 105.

The first lever arm 81 typically comprises: (i) a substantially linear portion having a bore 101 configured to receive a fastener therein for securing the drum rim clip 75 to idiophone 100; and (ii) a hooked distal end portion 110 which extends linearly away from the intersection there between, the hooked distal end portion 110 being configured to interface with the top edge of a drum rim. The second lever arm 82 is substantially linear, and includes: (i) a pair of arm holes 115 at its distal end in which a pivot rod 95 is received therein; (ii) an adjustable slider 85 having a hooked or bent distal end portion 111 which extends linearly from the second lever arm 82; and (iii) a threaded hole 125 at the second lever arm's 82 proximal end in which a clip adjustment screw 105 may be received therein, the clip adjustment screw 105 extending and retracting the adjustable slider 85 contained within the second lever arm 82. The hooked or bent distal end portion 110 may vary in shape to accommodate varying drum rim configurations.

The first lever arm 81 and second lever arm 82 are pivotally joined by pivot rod 95. A spring member 90 is positioned on pivot rod 95, with the ends bracing against first lever arm 81 and second lever arm 82. The drum rim clip 75 is actuatable between a closed first position and an open second position by applying pressure and depressing the second lever arm 82. Once the drum rim clip 75 is removably coupled with a drum rim, the clip adjustment screw 105 can be used to either extend or retract the adjustable slider 85 to adjust or pivot the position of the mounted idiophone 100 relative to the playing surface, as may be desired depending on the drum rim configuration.

The first lever arm 81 and second lever arm 82 are typically fabricated from plastic, although levers made of other materials, such as aluminum or steel, are also contemplated. In some variations, the distal ends of both the first lever arm 81 and second lever arm 82 may be coated with a rubber or elastomeric coating to prevent the distal ends of the respective lever arms from marring the drum or drum rim at the points of connection therewith. In other variations, the second lever arm 82 may further include a barrier cap 135, to secure the clip 75 to the drum and for protecting the surface of the drum rim from undesirable wear and tear. The barrier cap 135 may vary in diameter depending on the drum rim configuration.

As shown in FIG. 7A, when the sprung striker assembly 5 is in its resting position, the distal end of striker tip 20 is positioned approximately % inch to 2 inches above the idiophone 100. The distance between striker tip 20 and idiophone 100 may be adjusted by increasing or decreasing the angle of the bend in the first spring mechanism 25 and/or in the second spring mechanism 26. Once the body member 10 of sprung striker assembly 5 is struck by the user, the body member 10 moves downwardly until the striker tip 20 strikes idiophone 100, and then "springs" back into its resting position, enabling body member 10 or top striking portion 16 to be struck repeatedly in the desired rhythm and tempo of the musical composition. A sprung striker assembly 5 in a striking position is shown in FIG. 7B.

A Second Embodiment Sprung Striker Assembly for Striking an Idiophone

A second embodiment sprung striker assembly 205 for striking an idiophone 200 is illustrated in FIGS. 8-13. The second embodiment sprung striker assembly 205 comprises a striker head 15, a striker tip 20, a body member 10, and a first spring mechanism 25 comprising a leaf spring 220. As shown in FIGS. 10A-10B, the second embodiment sprung striker assembly 205 is operationally coupled to a generally vertically oriented rod 206 having a rod mounted idiophone 200 with a rod mount assembly 225.

Figure 8:
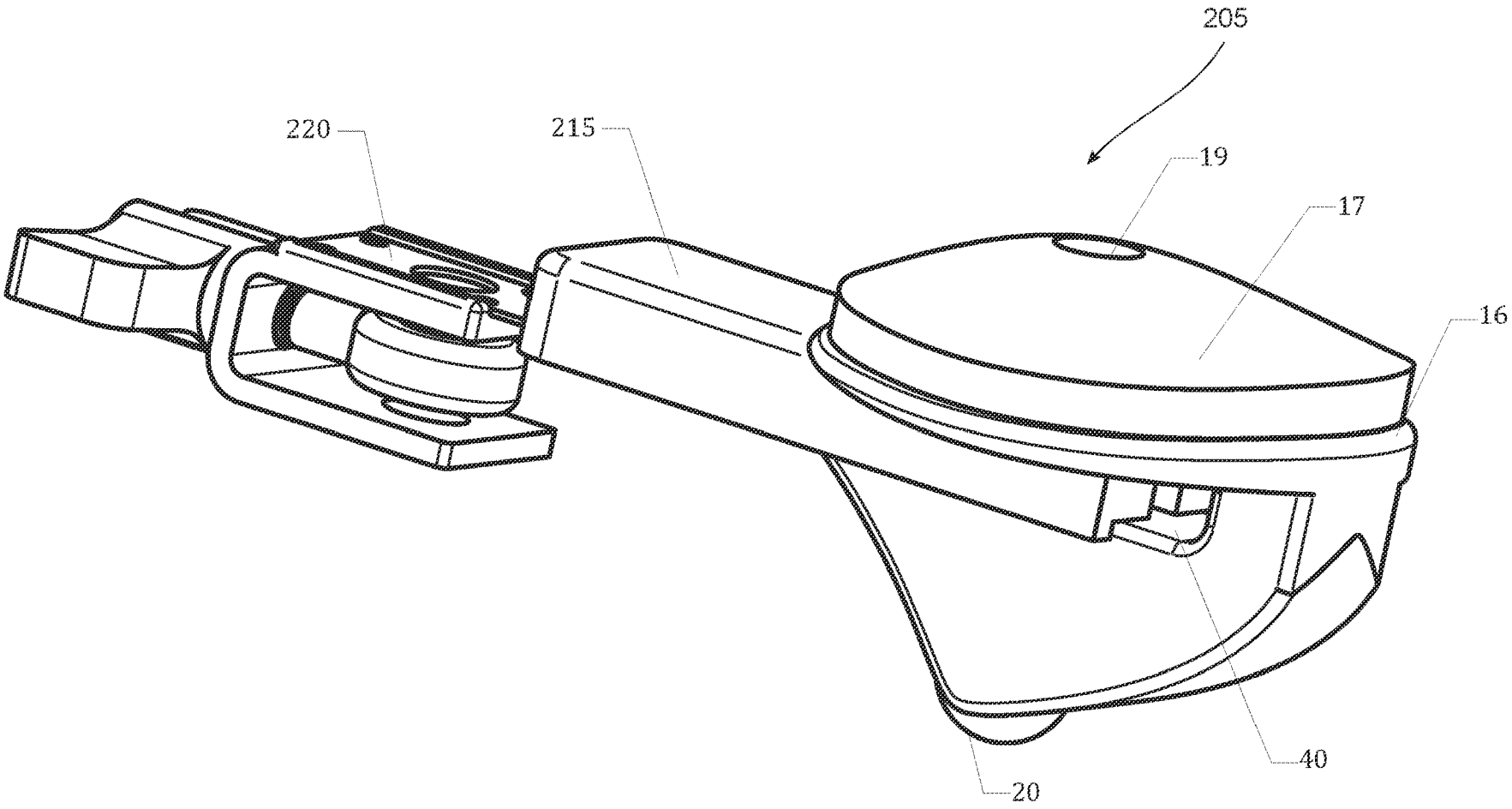
FIG. 8 is a perspective view of a second embodiment sprung striker assembly.
Figure 9:
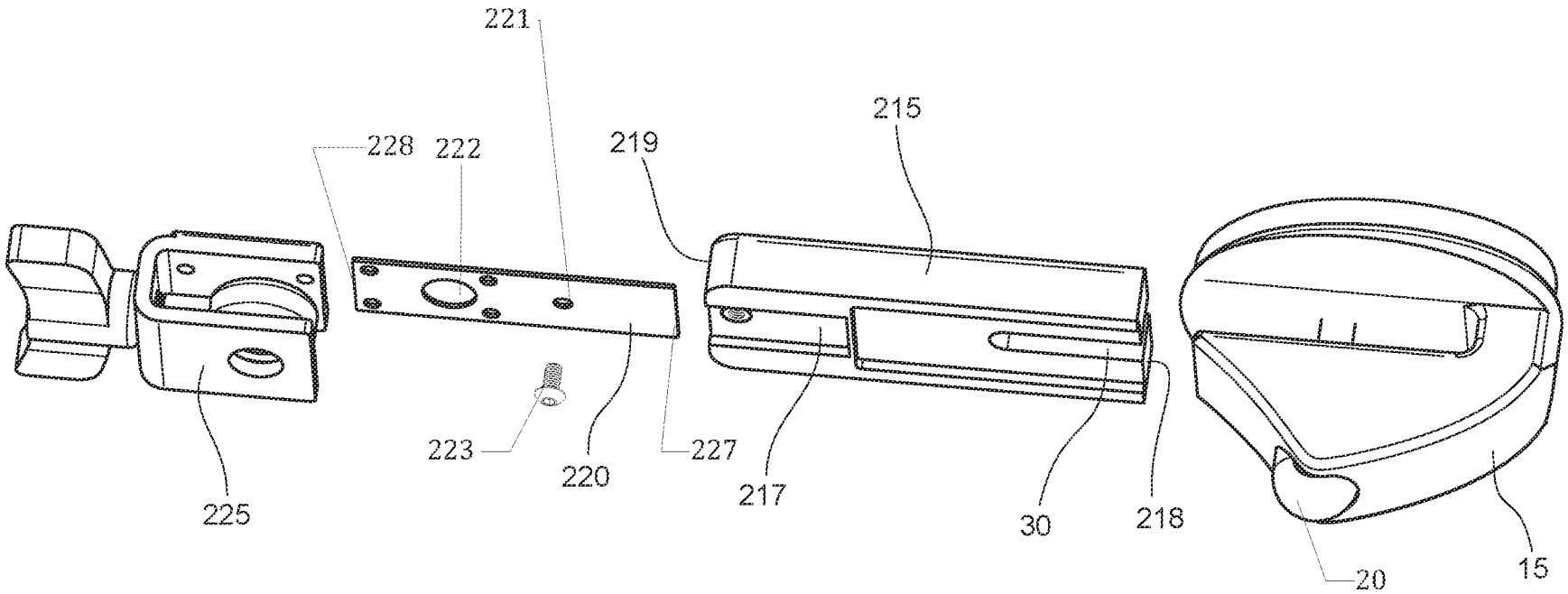
FIG. 9 is an exploded view of a second embodiment sprung striker assembly.

Referring to FIG. 9, a body member 10 having a linear bolt slot 30 and a plate channel 217 is shown. In the variation illustrated in FIGS. 8 & 9, body member 10 comprises a striker adaptor plate 215. As shown in FIG. 9, a linear bolt slot 30 is provided at the second end 218 of striker adaptor plate 215, and is configured for receiving and securing a striker head 15 thereon. A plate channel 217 is provided on the bottom surface of striker adaptor plate 215, and is configured to receive and a leaf spring 220 therein proximate the first end 219. Typically, striker adaptor plate 215 comprises a plastic material. In other variations, striker adaptor plate 215 can comprise wood, metal, rubber, or any other suitable material.

Referring to FIGS. 4A-4C, a striker head 15 having a mounting channel 40, a top striking portion 15, and a bottom striker tip portion 23 is shown. The top striking portion 16 of striker head 15 is typically a substantially smooth surface, to allow for the user to comfortably strike the either the top surface of body member 10 or striker head 15. The top striking portion 16 of striker head 15 further includes a bored hole 18, wherein the bored hole 18 is substantially perpendicular to mounting channel 40. In some variations, a sound dampening cap 17 including a cap hole 19 may be included on the top striking surface 16 of striker head 15. Typically, sound dampening cap 17 comprises a sound dampening or sound deadening material, such as high density foam, to allow for a user to strike the top striking surface 16 of striker head 15 with a drum stick with minimal sound, ensuring the resulting sound is predominately that which is created by the striker tip 20 striking the idiophone 200. Additionally, the sprung striker assembly 5 can also protect the idiophone 200 from damage that may otherwise occur when a user strikes the idiophone 200 with the user's drum stick.

As illustrated in FIGS. 8 & 9, the striker head 15 is adjustably coupled to striker adaptor plate 215 by sliding mounting channel 40 over linear bolt slot 30. The striker head 15 allows for the user to adjust the position of the striker head 15 with respect to striker adaptor plate 215, as may be necessary to ensure the sprung striker assembly 205 strikes idiophone 200 at a consistent location for producing the desired characteristic sound in a consistent manner. Once the striker head 15 is positioned at the desired location along linear bolt slot 30, the striker head 15 is secured into place by receiving threaded bolt 45 through each of mounting channel 40 and linear bolt slot 30. A striker tip 20 is threadably received on the distal end 65 of threaded bolt 45, and threaded bolt 45 is tightened until striker head 15 is secured into place.

The location at which striker tip 20 strikes idiophone 200 can be adjusted simply by adjusting the position at which the striker head 15 is coupled with body member 10 or striker adaptor plate 215. This can be accomplished by loosening threaded bolt 45 or striker tip 20, and sliding mounting channel 40 of striker head 15 along linear bolt slot 30 until striker tip 20 is positioned to strike idiophone 200 at the desired location, and then re-securing striker head 15 in place by threadably receiving striker tip 20 on the distal end 65 of threaded bolt 45, and re-tightening threaded bolt 45 until striker tip 20 is securely coupled with striker head 15 and the striker head 15 is again secured into place.

Figure 10B:
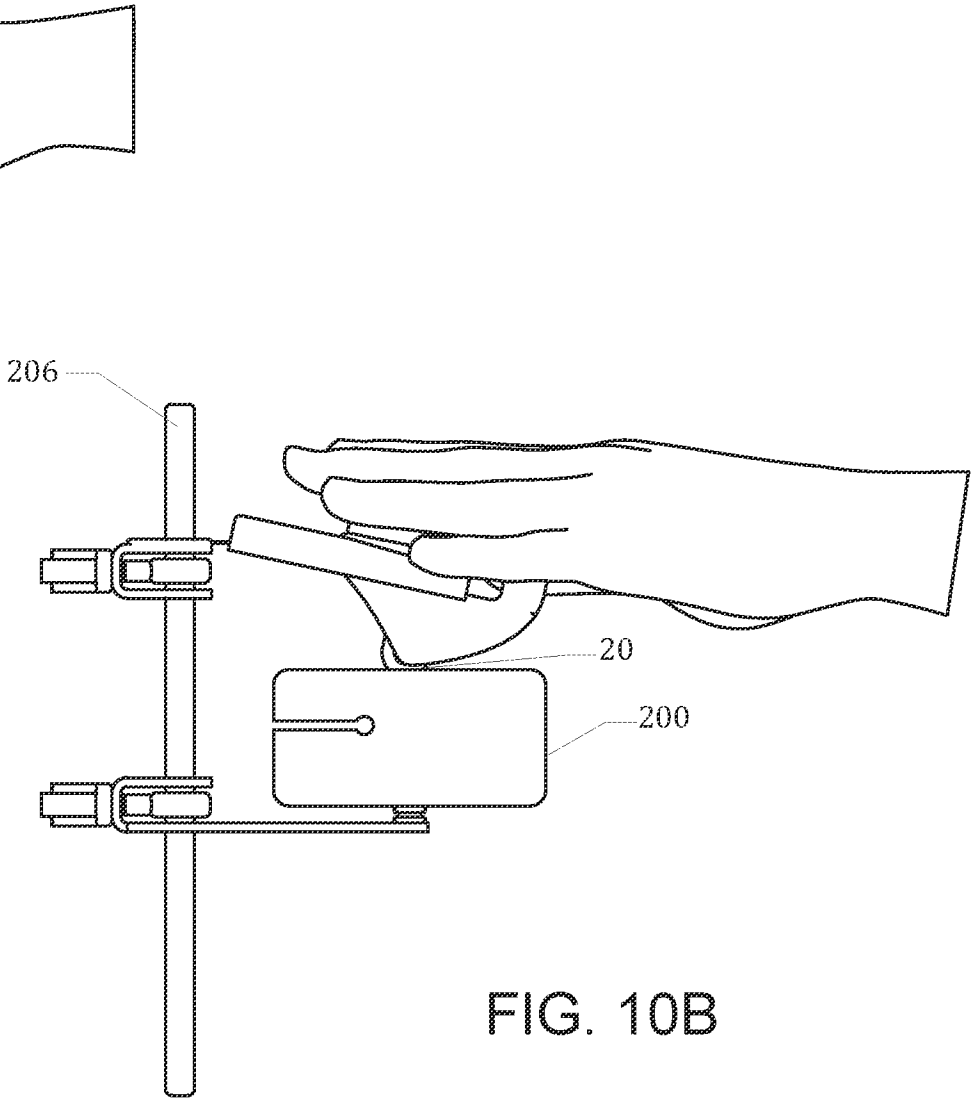
FIG. 10B is a side view of a second embodiment sprung striker assembly.
Figure 10A:
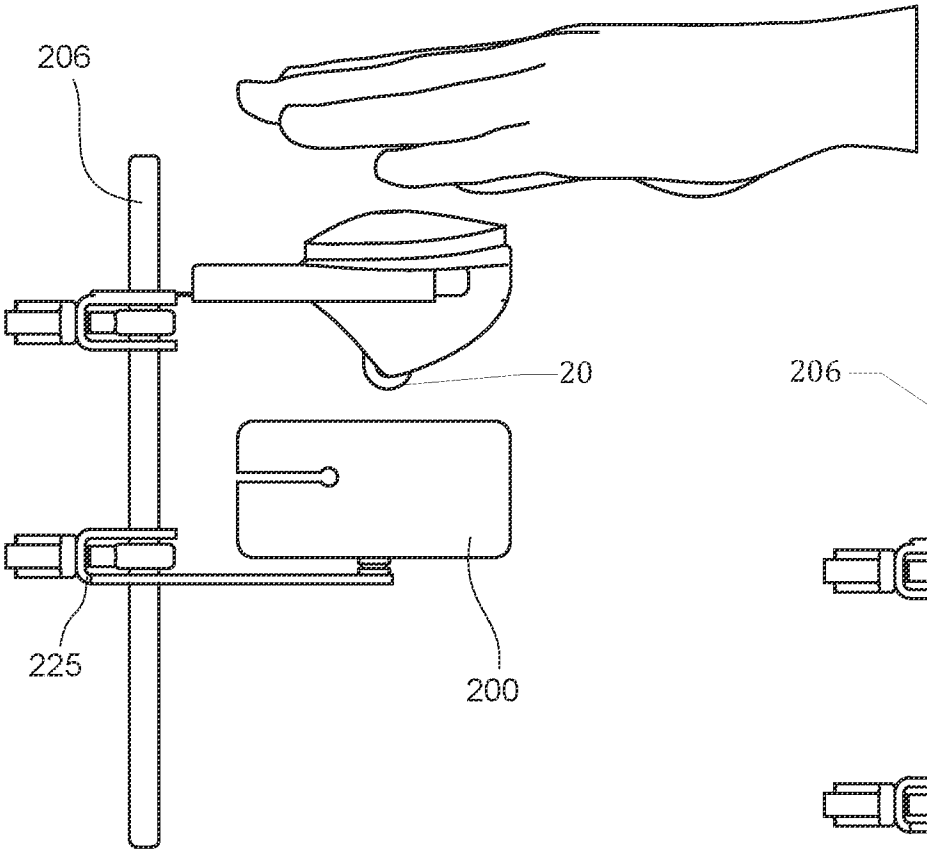
FIG. 10A is a side view of a second embodiment sprung striker assembly.

Referring to FIGS. 10A-10B, and sprung striker assembly 205 in a respective resting position and striking position is shown. When the user strikes sprung striker assembly 205, the distal end of striker tip 20 comes into contact—or 'strikes'—idiophone 200, thereby creating the desired characteristic sound from idiophone 200. Unlike when a user strikes an idiophone directly, the striker tip 20 enables the user to cause idiophone 200 to be stuck at the same location every time the sprung striker assembly 205 is struck. This ensures idiophone 200 creates the desired characteristic sound in a consistent manner. The user is also enabled to strike idiophone 200 with striker tip 20 by striking the sprung striker assembly 205 by either the user directly or with a drum stick.

To change the tone or volume of the idiophone 200 when struck by the striker tip 20, a first striker tip 21 comprising a first material is removed from threaded bolt 45, and a second striker tip 22 having a second material is threadably received on threaded bolt 45, and threaded bolt 45 is tightened with the second striker tip 22. Striker tip 20 may be comprised of a plurality of suitable materials, depending on the characteristic sound one desires to produce when idiophone 200 is struck with striker tip 20. For example, in one variation, a first striker tip 21 may comprise a soft plastic material, and a second striker tip 22 may comprise a metal material, such as steel. Other suitable materials can include plastic, wood, polymers, and other materials.

As shown in FIGS. 2 and 4A, the striker tip 20 typically includes a threaded bore 46 configured for threadably receiving threaded bolt 45 therein. Striker tip 20 is configured to be threadably received on a distal end 65 of threaded bolt 45 and securely coupled with striker head 15 when tightened with threaded bolt 45. In some variations, threaded bore 46 may further include a threaded tip insert 47 received therein. In some variations, threaded bore 46 may further include a threaded tip insert 47 received therein. The threaded tip insert 47 typically comprises a metal material, and can decrease the wear on striker tip 20 that may otherwise result from the repeated removal and re-coupling of threaded bolt 45 with striker tip 20. In some variations, the weight of threaded tip insert 47 or threaded bolt 45 may be increased or decreased to change the tone or volume of the idiophone 200 when struck by the striker tip 20. In variations wherein a bolder or more pronounced characteristic sound is desired, the weight of threaded tip insert 47 may be increased. As shown in FIG. 4A, threaded bore 46 is typically configured such that vertical axis of striker tip 20 and threaded bolt 45 is substantially perpendicular when the sprung striker assembly 5 is in a striking position.

In variations wherein the striker head 15 includes a striker head idiophone 50, the striker tip 20 typically comprises a sound-dampening material, such as rubber. In these variations, striker tip 20 provides for the controlled rapid stop of striker head 15 while dampening the sound of striker head 15 coming into contact with idiophone 200, as well as any non-idiophone, such as a mounted block having a striking surface, ensuring that the resulting dominant sound is that which emits from striker head idiophone 50.

As shown in FIG. 9, a plate channel 217 is provided on the bottom surface of striker adaptor plate 215, and is configured to receive and secure a leaf spring 220 therein. The leaf spring 220 typically includes a rod mount hole 222 for receiving a rod 206 therein, and a set screw hole 221 for receiving a set screw 223 therein. To couple striker adaptor plate 215 with leaf spring 220, the distal spring end 227 of leaf spring 220 is received within the plate channel 217 of striker adaptor plate 215, and is secured in place with set screw 223. The leaf spring 220 is then coupled with a rod mount assembly 225 proximate the proximal spring end 228, at which point the sprung striker assembly 205 is ready to be operationally coupled with a rod 206. A second embodiment sprung striker assembly 205 operationally coupled to a rod 206 having a rod mounted idiophone 200 with a rod adaptor assembly 225 is shown in FIGS. 10A & 10B.

Figure 12:
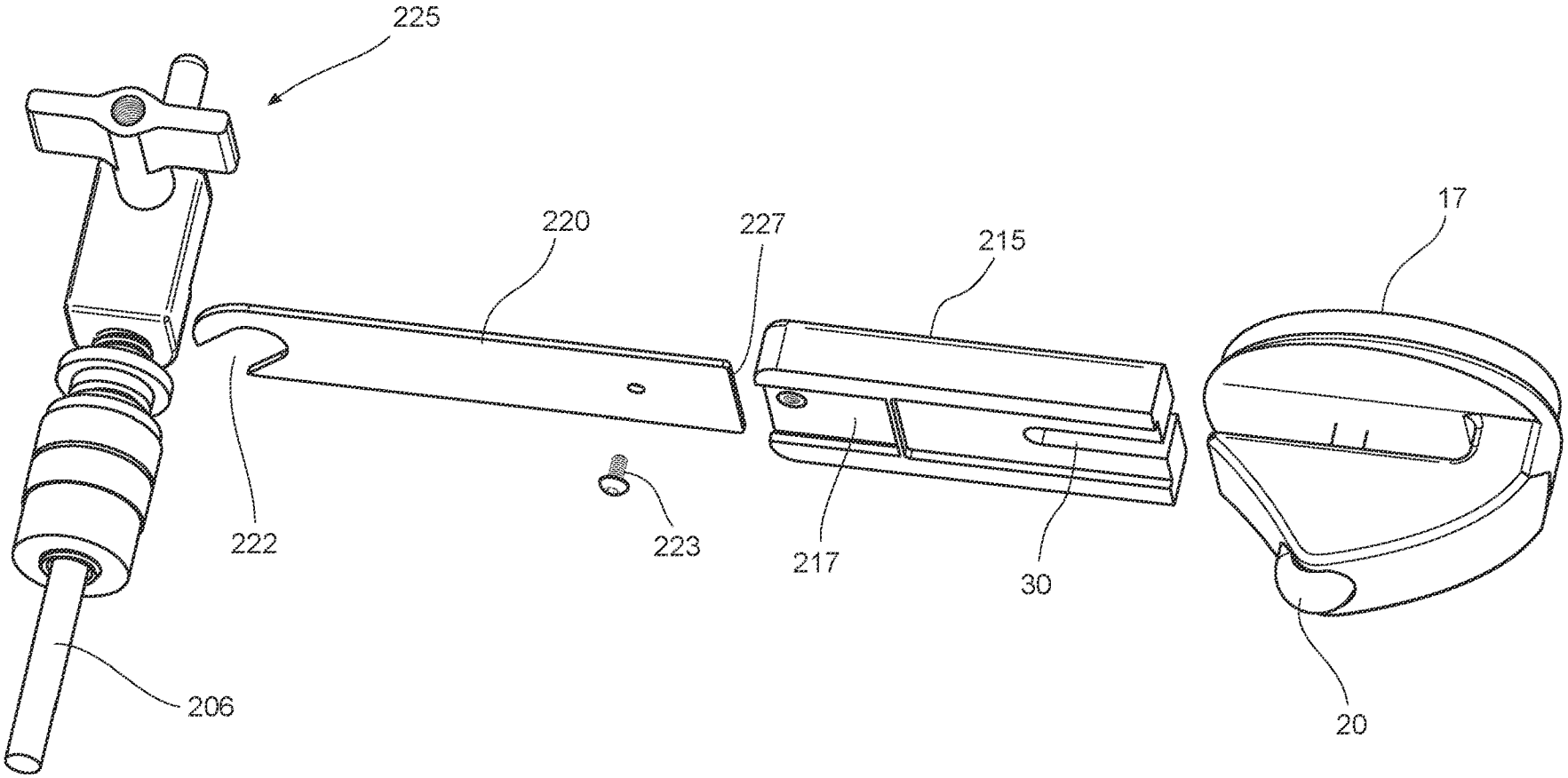
FIG. 12 is an exploded view of a second embodiment sprung striker assembly.
Figure 13:
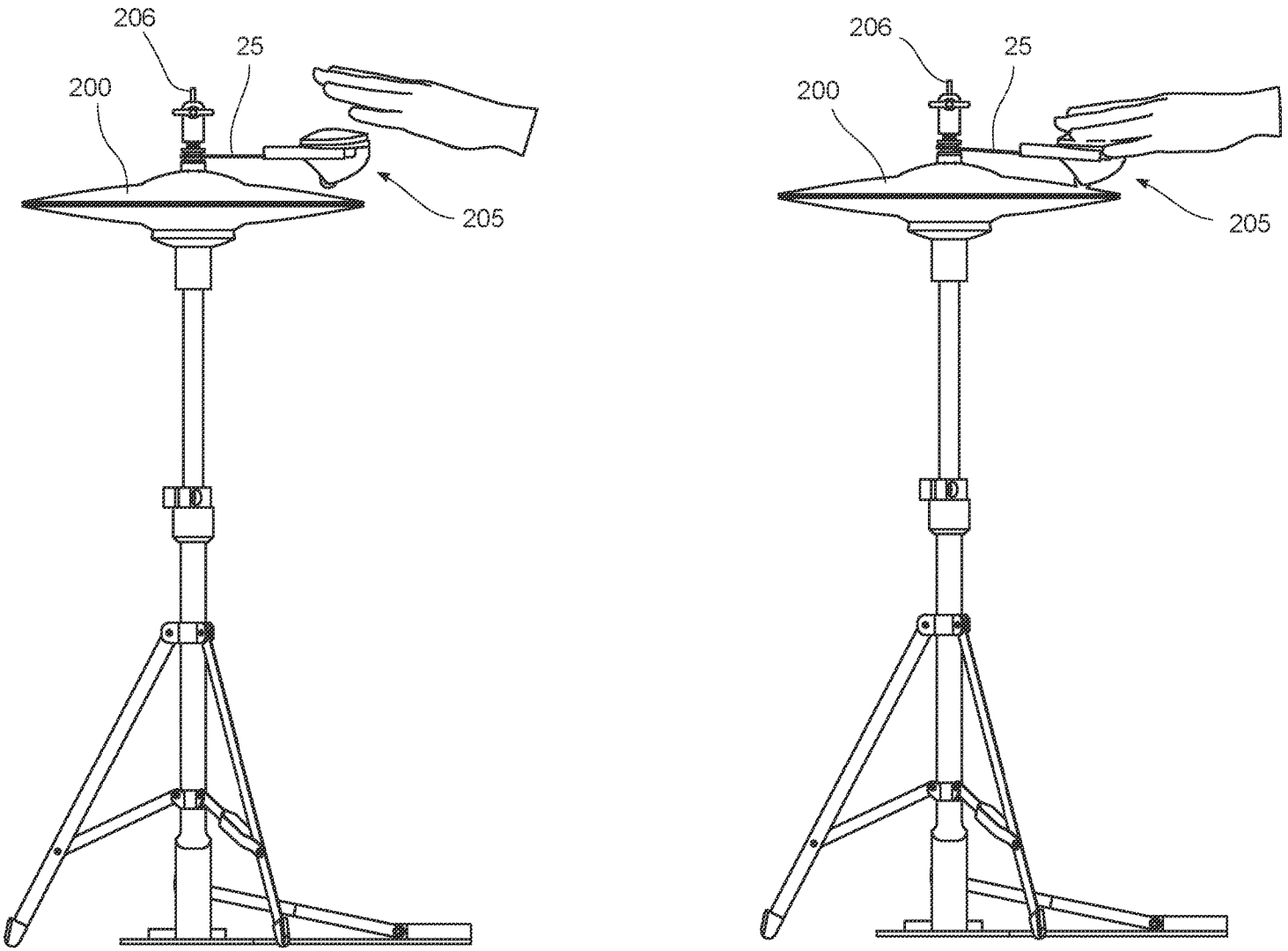
FIG. 13 is a side view of a second embodiment sprung striker assembly.

In one variation, the sprung striker assembly 205 may be operationally coupled with a rod 206 having a high hat, as illustrated in FIGS. 12, 13A & 13B. In this variation, the striker head 15 is coupled with the striker adaptor plate 215, and the distal spring end 228 of leaf spring 220 is received within the plate channel 217 of striker adaptor plate 215 and secured in place with set screw 223. A rod 206 is then typically received within a rod mount hole 222 configured for receiving a rod 206 therein, and the sprung striker assembly is operationally secured to a high hat rod with a rod mount assembly 225 such as a standard high hat clutch. A second embodiment sprung striker assembly 205 operationally coupled with a high hat rod is illustrated in FIG. 13.

Figure 11B:
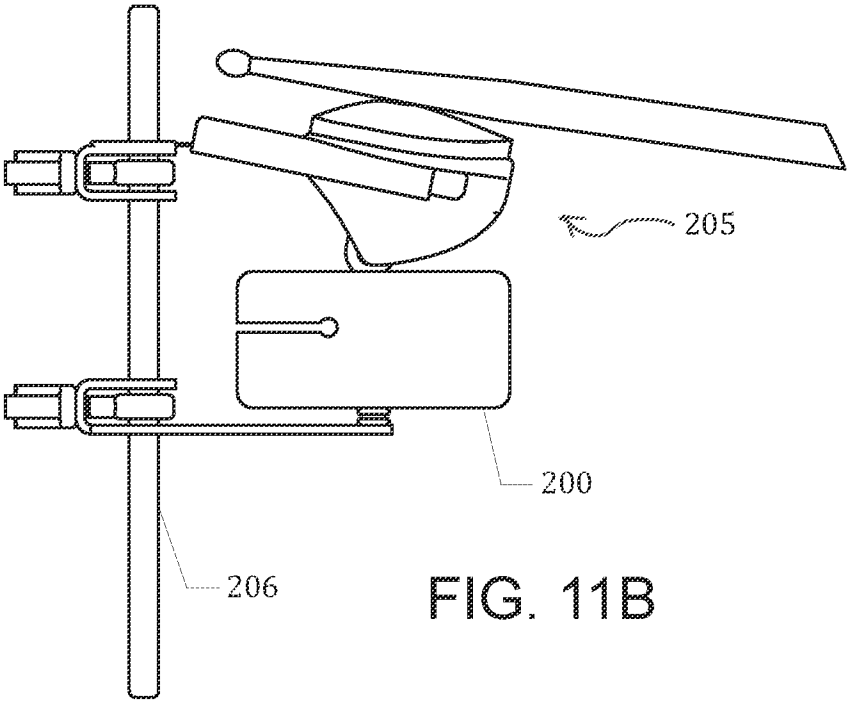
FIG. 11B is a side view of a second embodiment sprung striker assembly.
Figure 11A:
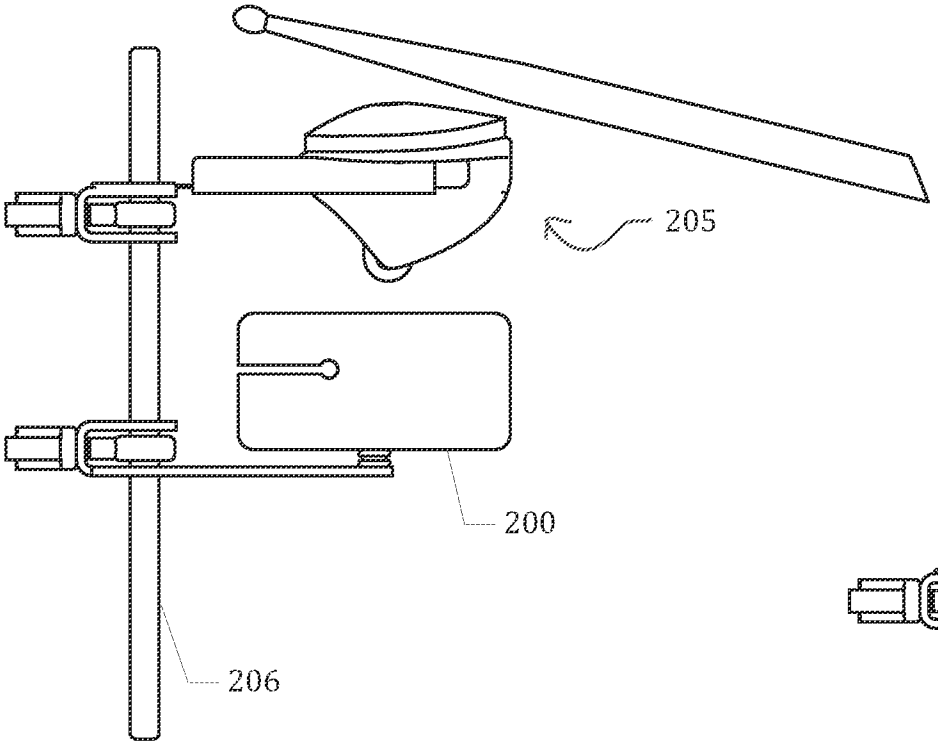
FIG. 11A is a side view of a second embodiment sprung striker assembly.

As shown in FIGS. 10A & 10B when the sprung striker assembly 205 is in its resting position, the distal end of striker tip 20 is positioned approximately ¼ inch to 2 inches above the idiophone 200. The distance between striker tip 20 and idiophone 200 may be adjusted by increasing or decreasing the mounting position of sprung striker assembly 205 with respect to idiophone 200 when coupling the leaf spring 220 to the rod. Additionally, the position of sprung striker assembly 205 can be adjusted by reshaping or otherwise adjusting the curvature the leaf spring 220. Once the striker head 15 of sprung striker assembly 205 is struck by the user, the striker head 15 moves downwardly until the striker tip 20 strikes idiophone 100, and the leaf spring 220 then enables the sprung striker assembly 205 to "spring" back into its resting position. Thus, the leaf spring 220 allows for striker head 15 to be struck repeatedly in the desired rhythm and tempo of the musical composition. A sprung striker assembly 205 in a striking position is shown in FIGS. 10B & 11B.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A sprung striker assembly for use with an idiophone, the sprung striker assembly comprising a striker head and a first spring mechanism, the first spring mechanism having a proximal spring end and a distal spring end, the proximal spring end including a striker attachment mechanism, and the striker head being coupled with the first spring mechanism proximate the distal spring end, wherein the striker head includes a top striking portion configured to be struck by a user and a bottom striker tip portion configured for striking the idiophone.

2. The sprung striker assembly of claim 1 in combination with the idiophone, wherein the striker head is positioned operationally above the idiophone.

3. A sprung striker assembly in combination with an idiophone, wherein the striker head is positioned operationally above the idiophone wherein:

the sprung striker assembly comprises a striker head and a first spring mechanism, the first spring mechanism having a proximal spring end and a distal spring end, the proximal spring end including a striker attachment mechanism, and the striker head being coupled with the first spring mechanism proximate the distal spring end;

the idiophone includes at least one drum rim clip configured for attachment to a rim of a drum; and wherein the striker attachment mechanism couples to the at least one drum rim clip.

4. The combination of claim 2 further including a generally vertically oriented rod wherein (i) the idiophone is coupled to the rod, and (ii) the striker attachment mechanism is coupled to the rod at a location above the idiophone.

5. The sprung striker assembly of claim 1 further comprising a body member, the body member having a first end and a second end, the first end attaching to the first spring mechanism and the second end coupling to the striker head.

6. The sprung striker assembly of claim 5 wherein the striker head further includes a threaded bolt, the threaded bolt securing the striker head to the body member.

7. The sprung striker assembly of claim 6 wherein the bottom striker tip portion comprises a first striker tip, the first striker tip having a threaded bore and being removably received over a distal end of the threaded bolt.

8. The sprung striker assembly of claim 7 further including at least a second striker tip portion having a threaded bore, the second striker tip being comprised of a different material than the first striker tip, each of the first and second striker tip being interchangeably receivable over the distal end of the threaded bolt.

9. The sprung striker assembly of claim 6 wherein a longitudinal axis of the threaded bolt is axially aligned with the bottom striker tip.

10. The sprung striker assembly of claim 1 wherein the first spring mechanism comprises a first elastically resilient wire.

11. The combination of claim 3 wherein (i) the first spring mechanism comprises an elastically resilient wire, (ii) the at least one drum rim clip includes a bored stem, (iii) the striker attachment mechanism comprises the proximal spring end, and (iv) the proximal spring length is received in the bored stem.

12. The combination of claim 4 wherein the first spring mechanism comprises a leaf spring.

13. The combination of claim 4 wherein the striker attachment mechanism is attached to a proximal end of the leaf spring.

14. The sprung striker assembly of claim 1 wherein the striker head further includes a sound dampening cap received over the top striking portion.

15. The sprung striker assembly of claim 5 wherein a position of the striker head on the body member is adjustable to vary a length between the striker head and the striker attachment mechanism.

16. The spring striker assembly of claim 5 wherein the striker head further includes a striker head idiophone.

17. The sprung striker assembly of claim 7 wherein a position of the striker head on the body member is adjustable to vary a length between the bottom striker tip portion and the striker attachment mechanism.

18. A sprung striker assembly for use with an idiophone, the sprung striker assembly comprising:

a striker head, the striker head including a top striking portion configured to be struck by a user, a bottom striker tip portion having a threaded bore, and a threaded bolt, the threaded bolt securing the striker head to a body member, wherein a longitudinal axis of the threaded bolt is axially aligned with the bottom striker tip portion, the bottom striker tip portion being removably received over a distal end of the threaded bolt;

the body member, the body member having a first end and a second end, the first end attaching to a first spring mechanism and the second end coupling to the striker head, wherein a position of the striker head on the body member is adjustable to vary a length between the bottom striker tip portion and the striker attachment mechanism; and the first spring mechanism, the first spring mechanism having a proximal spring end and a distal spring end, the proximal spring end including a striker attachment mechanism, and the striker head being coupled with the first spring mechanism proximate the distal spring end.

19. The sprung striker assembly of claim 18 wherein the first spring mechanism comprises a leaf spring.

* * * * *